US008950350B2

(12) United States Patent
Merrill

(10) Patent No.: US 8,950,350 B2
(45) Date of Patent: Feb. 10, 2015

(54) EXTENSIBLE SHIELD FOR PROTECTING THE ATTACHMENT ENDS OF A STRETCHABLE MOORING RODE SEGMENT

(71) Applicant: David A Merrill, Temple, NH (US)

(72) Inventor: David A Merrill, Temple, NH (US)

( * ) Notice: Subject to any disclaimer, the term of this patent is extended or adjusted under 35 U.S.C. 154(b) by 43 days.

(21) Appl. No.: 13/925,882

(22) Filed: Jun. 25, 2013

(65) Prior Publication Data

US 2013/0340665 A1 Dec. 26, 2013

Related U.S. Application Data

(60) Provisional application No. 61/664,185, filed on Jun. 26, 2012.

(51) Int. Cl.
*B63B 21/00* (2006.01)
*B63B 21/20* (2006.01)

(52) U.S. Cl.
CPC ..... *B63B 21/20* (2013.01); *B63B 2021/005* (2013.01); *B63B 2221/00* (2013.01); *B63B 2021/203* (2013.01); *B63B 2221/18* (2013.01)
USPC ..... 114/230.24; 114/230.2

(58) Field of Classification Search
USPC ..... 114/230.2–230.3
See application file for complete search history.

(56) References Cited

U.S. PATENT DOCUMENTS

| | | | | |
|---|---|---|---|---|
| 4,258,608 | A * | 3/1981 | Brown | 87/6 |
| 4,534,262 | A * | 8/1985 | Swenson | 87/6 |
| 4,597,351 | A * | 7/1986 | Brainard, II | 267/74 |
| 5,136,755 | A * | 8/1992 | Shaw | 24/122.6 |
| 5,192,144 | A * | 3/1993 | Doninger | 403/209 |
| 5,383,905 | A * | 1/1995 | Golds et al. | 606/232 |
| 5,483,911 | A * | 1/1996 | Kubli | 114/230.22 |
| 6,390,009 | B2 * | 5/2002 | Brown et al. | 114/230.24 |
| 6,575,072 | B2 * | 6/2003 | Pellerin | 87/6 |
| 8,286,309 | B2 * | 10/2012 | Landry | 24/136 B |
| 8,495,964 | B1 * | 7/2013 | Ronald | 114/230.2 |
| 8,713,905 | B1 * | 5/2014 | Branscomb | 57/22 |
| 2005/0061223 | A1 * | 3/2005 | Carr | 114/230.2 |
| 2013/0340665 | A1 * | 12/2013 | Merrill | 114/230.24 |

* cited by examiner

*Primary Examiner* — Lars A Olson
*Assistant Examiner* — Jovon Hayes
(74) *Attorney, Agent, or Firm* — Maine Cernota & Rardin

(57) ABSTRACT

A fabric shielding tube protects an elastic end portion of a stretchable segment of a mooring rode from abrasion, water, and marine life, without inhibiting extension of the stretchable segment. The ends of the tube are attached to the rode at the ends of the elastic end portion, with the tube extending beyond the elastic portion and folding back on itself in a rolling wall configuration. The tube thereby adapts to extension of the rode by partially unrolling the rolling wall. At its distal end, the tube is attached only to an outer braid of the rode by a means that does not inhibit extension of the braid or of an elastomeric core within the braid. The distal end attachment can be by sewing, or by interweaving of a strap such as a cable tie through the shield and the braid. The fabric shield can include nylon.

16 Claims, 7 Drawing Sheets

EXTENSIBLE SHIELD FOR PROTECTING THE ATTACHMENT ENDS OF A STRETCHABLE MOORING RODE SEGMENT

RELATED APPLICATIONS

This application claims the benefit of U.S. Provisional Application No. 61/664,185, filed Jun. 26, 2012, which is herein incorporated by reference in its entirety for all purposes.

FIELD OF THE INVENTION

The invention relates to nautical mooring lines, and more particularly, to segments of mooring rodes that are stretchable.

BACKGROUND OF THE INVENTION

A stretchable section is often included in a mooring cable or anchor rode for partly absorbing the stresses caused by wave actions on small boats, on buoys, or on similar floating structures. The elastic stretching of the rode helps to prevent damage to the craft or floating structure, as well as helping to prevent the loosening of its anchor. A stretchable segment is also sometimes included in a tow rope for dampening the shock of accelerating a floating object from rest, and for helping to even out the fluctuations in tension due to wave action during towing.

Generally, these stretchable segments include an elastomeric core surrounded by an extensible woven braid made from a synthetic polymer such as polyester or polyolefin.

A tension on the stretchable segment causes the braided outer layer of the rope to expand without resistance, while the inner elastic core stretches elastically and with increased resistance. Eventually, the braided outer layer reaches its maximum length, whereupon the tension load is transferred from the inner core to the outer braid, and the stretchable segment maintains its length until the tension is relieved.

An anchor rode is often partially wound on a capstan or around sheaves, and has shackles or knots at both ends thereof. Therefore, an anchor rode needs to be non-elastic along the segments thereof which are used for tying and along the segments susceptible to slippage and sharp bending. Hence, it is often desirable to make only a short segment of the anchor rode stretchable, as opposed to its full length. As a result, both ends of the stretchable segment are often submerged in a relatively harsh marine environment while in use, and are subject to both chemical and biological deterioration.

FIG. 1A illustrates a rode 10 being used to tether a ship 12 to an anchor 14, and FIG. 1B illustrates a rode 10 being used to tether a dock 18 floating on the surface 20 of an ocean, river, or lake, to the bottom 22 of the ocean, river, or lake. In both cases the rode 10 includes a stretchable segment 16 that remains entirely submerged while the rode 10 is in use.

Various methods are used to attach the elastomeric core to the braid at the ends of the stretchable segment 16. Typically, the elastomeric core emerges from the outer braid at each end, and is clamped, taped, and/or interwoven with the outer braid. An example is shown in FIG. 1C, where the elastomeric core 100 emerges through the surrounding outer braid 102 near one end, is folded back along the outside of the outer braid 102, and is interwoven through some of the loops 104 of the braid 102 to hold it in place.

As is illustrated in FIG. 1D, the ends of the stretchable segment 16 are terminated by loops 106 or other attachment fittings. In the figure, a steel thimble 106 is spliced to the woven braid 102. In other applications, a steel hook or other attachment fitting is spliced to the woven shield 102, or a "soft loop" is formed from the fibers of the woven shield itself. Typically, the non-elastic end portions of the stretchable segment 16 are wrapped with tape or encased in heat shrinkable tubing 108 to cover the joining region where both the end loop 106 and the elastomeric core 100 are attached to the woven braid 102. This is for aesthetic reasons, and also to protect the exposed section of the elastomeric core from abrasion and chafing, and from chemical and biological attack. However, tape and/or heat-shrinkable tubing 108 can only be applied to the short, non-elastic sections of the stretchable segment 16 near each end, since the application of tape or heat shrinkable tubing 108 to the elastic portion of the stretchable segment 16 would inhibit the free extension of the braid when the segment is stretched.

Due to its smooth surface and other material properties, the tape or heat-shrinkable tubing 108 is typically resistant to water and salt, and is not susceptible to undue amounts of marine attachment and growth. The synthetic material of the outer woven braid 102 is also typically impervious to attack from fresh or salt water, and the regular extensions and contractions of the braid inhibit the attachment and growth of marine life.

However, the braid extensions are greatest at the center of the stretchable segment, and least near the ends. Therefore, a region often exists near each end of a stretchable segment of a rode where the covering braid is not protected by tape or heat-shrinkable tubing 108, and yet does not undergo sufficient extension and contraction to inhibit the attachment and growth of marine life. This can lead to an unappealing appearance, as well as maintenance issues when the mooring cable is raised and the attached marine life must be removed and disposed of. In the worst case, it can even lead to degradation and eventual mechanical failure of the rode.

What is needed, therefore, is a protective covering system for end portions of a stretchable segment of a mooring rode that inhibits access of surrounding marine life to the end portions but does not inhibit expansion and contraction of the end portions.

SUMMARY OF THE INVENTION

A fabric shield for protecting an elastic end portion of a stretchable segment of a mooring rode from abrasion and chafing, and also from surrounding water and marine life, includes a tube of shielding fabric arranged over the stretchable end portion in a rolling wall configuration that enables firm attachment of a distal end of the shield to the covering braid in the elastic end portion without inhibiting expansion and contraction of the elastic end portion. When the stretchable segment of the rode is stretched, the shield remains attached at both ends, and adapts to the change in length of the elastic end portion by partially unrolling the rolling wall.

The fabric shield of the present invention is attached to the non-elastic end of the stretchable segment of the rode at the shield's proximal end (the end nearest to the end of the rode) by any attachment means known the art, such as by sewing or clamping. The proximal end of the shield typically overlaps, or is overlapped by, the tape or heat-shrinkable tubing that covers the non-elastic end of the stretchable segment. The shield is attached at its distal end only to the braid of the elastic end portion by a means that does not inhibit stretching of the braid or movement of the elastomeric core within the braid. In some of these embodiments, the shield is attached to the braid at its distal end by sewing, and in other embodiments the shield is attached to the braid at its distal end by interweaving of a strap, such as a cable tie, through the shield and the braid.

In embodiments, the shield is made from nylon. In some embodiments the stretchable segment of the rode can be stretched to a length that is more than 50% longer than its unstretched length.

One general aspect of the present invention is a stretchable segment of a mooring rode having a shield for protecting a proximal elastic portion of the stretchable segment. The stretchable segment includes a stretchable section having an extendable outer braid surrounding an elastomeric inner core, the stretchable section being attached at one end to an inelastic end of the stretchable segment; a tube of shielding fabric, the tube being folded back onto itself, such that an inner portion of the tube extends from a distal end of the tube to a fold, and an outer portion of the tube extends back from the fold to a proximal end of the tube, the inner portion of the tube being thereby covered by the outer portion of the tube, and the distal end of the tube being thereby located between the proximal end of the tube and the fold; a first attachment mechanism fixing the proximal end of the tube to the inelastic end of the stretchable segment; and a second attachment mechanism fixing the distal end of the tube to the outer braid at a location distal to a proximal elastic portion of the stretchable section, so that the proximal elastic portion is covered by the tube, said second attachment mechanism being configured to allow substantially unhindered movement of the elastic inner core through the outer braid, so that expansion and contraction of the proximal elastic portion is substantially unhindered by attachment thereto of the tube.

In some embodiments, the second attachment mechanism includes stitches attaching the distal end of the tube to the outer braid. In other embodiments the second attachment mechanism includes a strap that is interwoven through the shielding fabric of the tube and the outer braid. And in some of these embodiments the strap is a cable tie.

In various embodiments the first attachment mechanism includes a clamp that compresses the proximal end of the tube against the inelastic end of the stretchable segment.

In certain embodiments, the stretchable segment is more than 50% longer in a maximally stretched configuration than it is in an unstretched configuration. In some embodiments the shielding fabric includes nylon.

And in embodiments, the inelastic end of the stretchable segment is covered by tape or by heat-shrinkable tubing.

Another general aspect of the present invention is a method for protecting a proximal elastic portion of a stretchable segment of a mooring rode, the stretchable segment including an extendable outer braid surrounding an elastomeric inner core, the proximal elastic portion being an elastic portion of the stretchable segment that is adjacent to an inelastic end of the stretchable segment. The method includes sliding a tube of shielding fabric over the stretchable segment and past the proximal elastic portion, so that a distal end of the tube is closest to the proximal elastic portion, but the tube does not surround any part of the proximal elastic portion; attaching the distal end of the tube to the outer braid of the stretchable segment using a first attachment mechanism that does not hinder extension of the extendable outer braid or of the elastomeric inner core; folding a proximal end of the tube back over the distal end, thereby creating a fold in the tube, such that the distal end of the tube is located between the proximal end and the fold; and attaching the proximal end of the tube to the inelastic end of the stretchable segment, so that the proximal elastic portion is fully covered by the tube.

In some embodiments, attaching the distal end of the tube to the outer braid of the stretchable segment includes sewing of the distal end of the tube to the outer braid. In other embodiments attaching the distal end of the tube to the outer braid of the stretchable segment includes interweaving of a strap through the shielding material and the outer braid. And in some of these embodiments the strap is a cable tie.

In various embodiments, attaching the proximal end of the tube to the inelastic end of the stretchable segment includes using a clamp to compresses the proximal end of the tube against the inelastic end.

In certain embodiments, the stretchable segment can be stretched to a length that is more than 50% longer than an unstretched length of the stretchable segment.

In some embodiments, the shielding fabric includes nylon. And in other embodiments, the inelastic end of the stretchable segment is covered by tape or by heat-shrinkable tubing.

The features and advantages described herein are not all-inclusive and, in particular, many additional features and advantages will be apparent to one of ordinary skill in the art in view of the drawings, specification, and claims. Moreover, it should be noted that the language used in the specification has been principally selected for readability and instructional purposes, and not to limit the scope of the inventive subject matter.

DETAILED DESCRIPTION

Figure 1A:
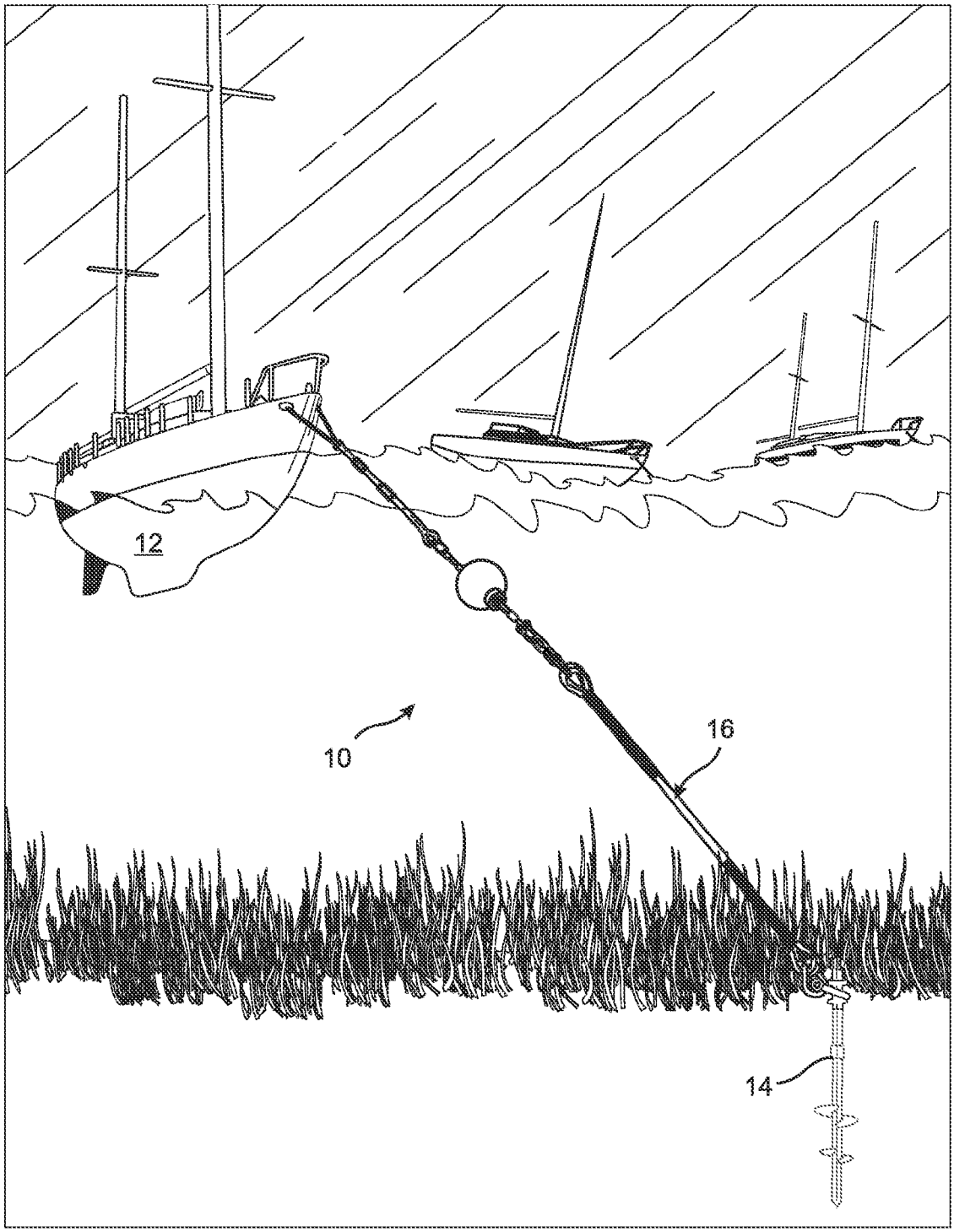
Figure 1A Prior Art
FIG. 1A is a prior art perspective view of a ship moored to an anchor by a rode that includes a stretchable segment.
Figure 1B:
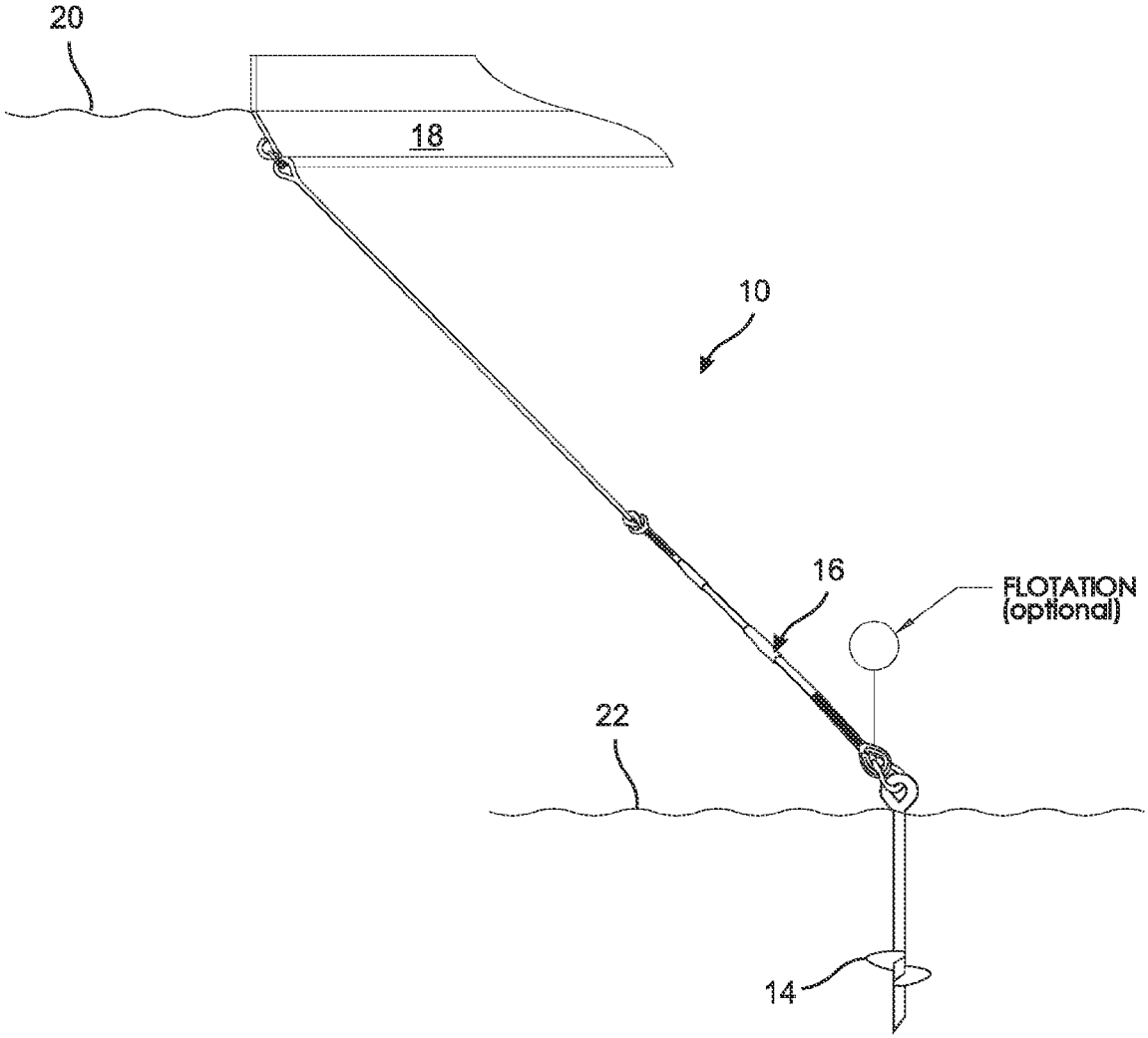
Figure 1B Prior Art
FIG. 1B is a prior art perspective view of a floating dock tethered to the bottom of an ocean, river, or lake by a rode that includes a stretchable segment.
Figure 1C:
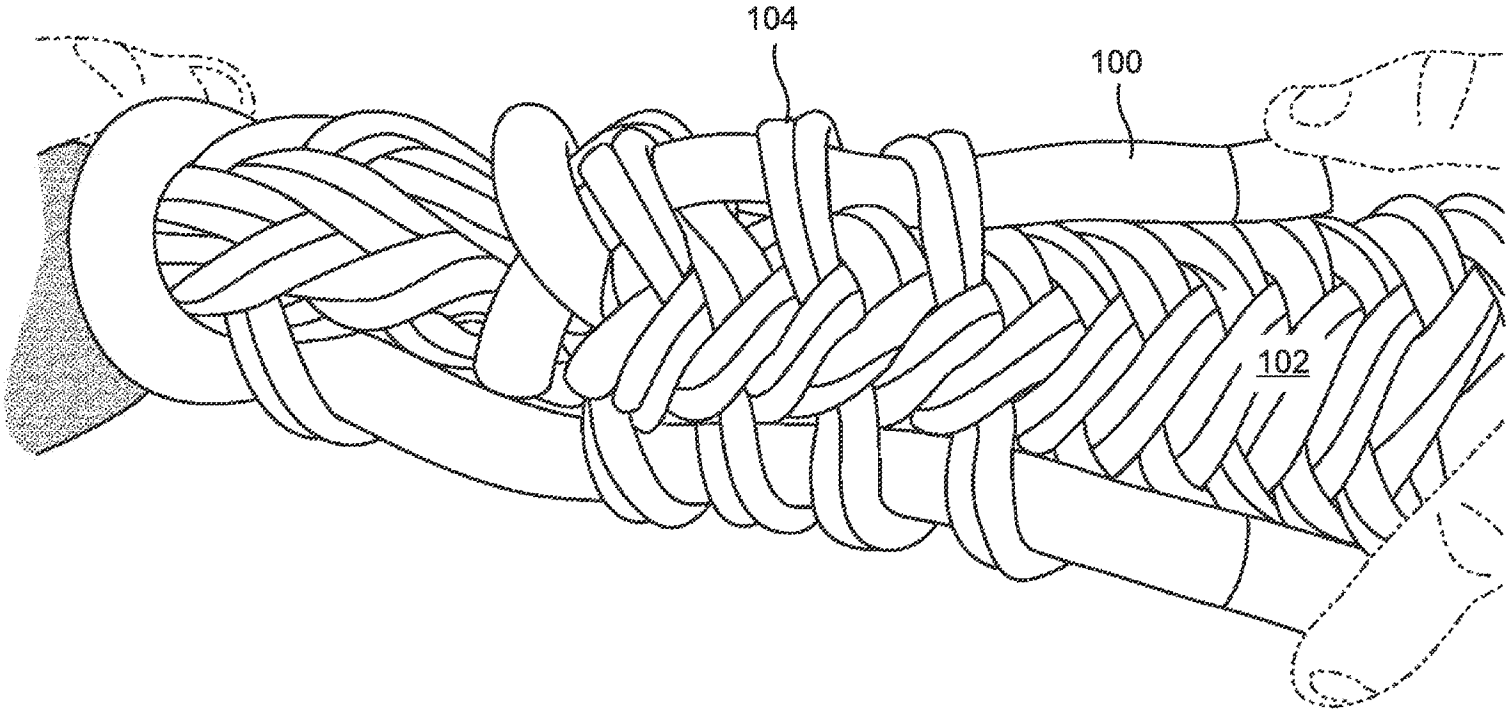
Figure 1C Prior Art
FIG. 1C is a prior art side view of one end of a stretchable segment of a rode, showing the central elastomeric core emerging from the braid and being interwoven with the braid for attachment thereto.
Figure 1D:
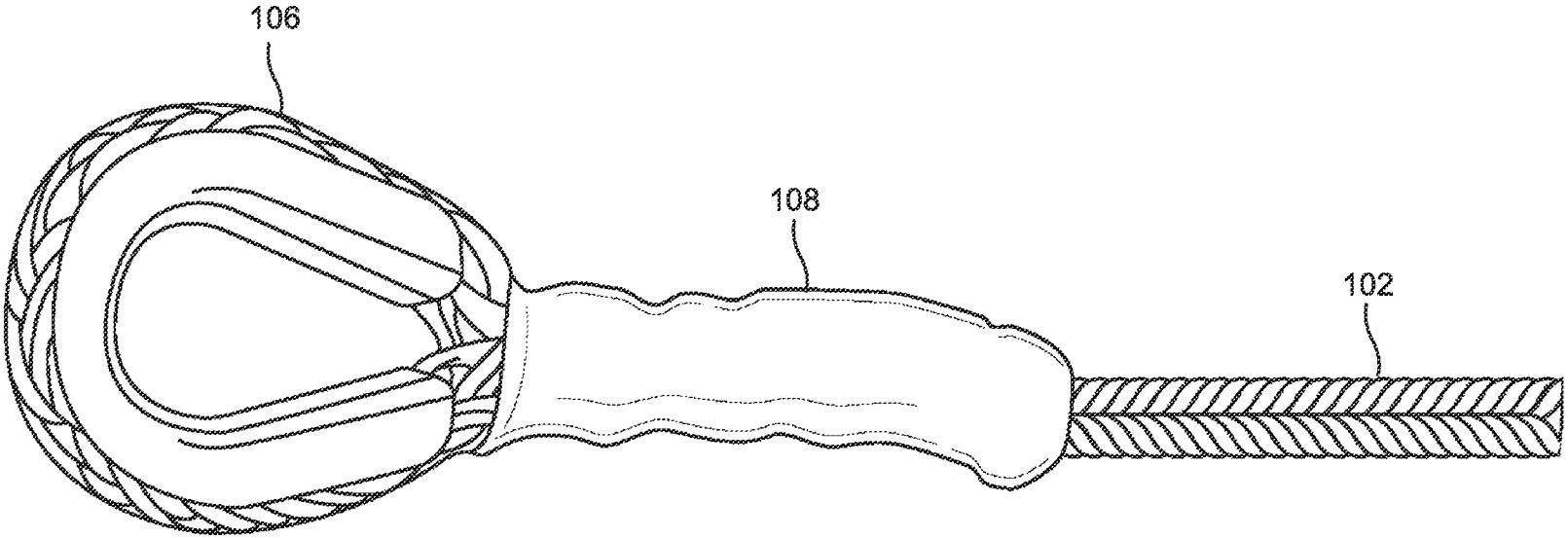
Figure 1D Prior Art
FIG. 1D is a prior art side view of the segment of FIG. 1B, showing the interwoven portion encased in heat shrinkable tubing.
Figure 2A:
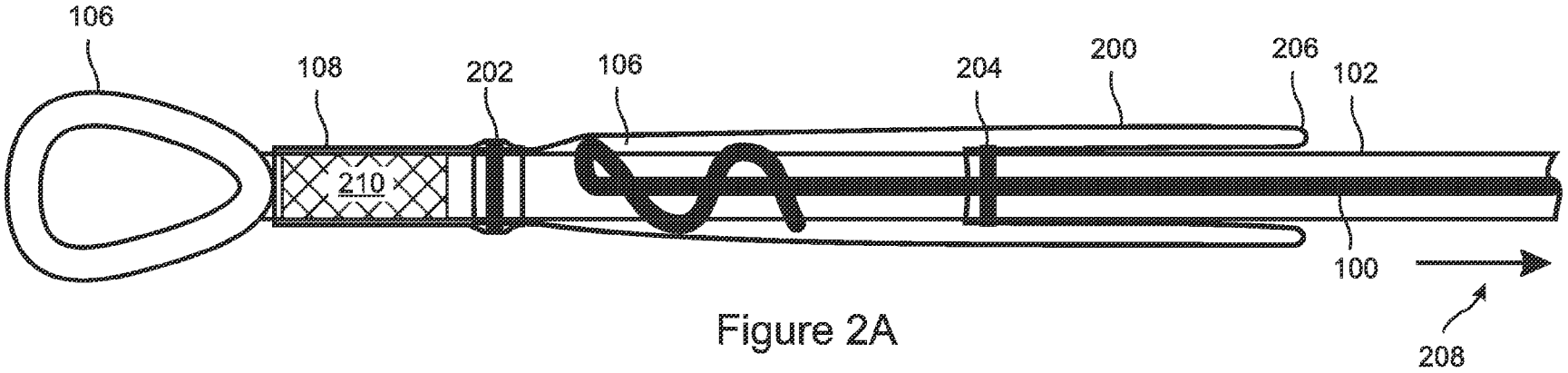
FIG. 2A is a cross-sectional side view of an embodiment of the present invention in its unstretched configuration.

With reference to FIG. 2A, the present invention is a fabric shield 200 for protecting an elastic end section of a stretchable segment 16 of a mooring rode 10 from abrasion and chafing, and also from surrounding water and marine life. The shield 200 is configured as a tube of shielding fabric 200 arranged in a "rolling wall" configuration, whereby an "outer portion" of the shield extends from its proximal end 202 (nearest to the end of the stretchable segment 16) to a fold 206, where it folds back on itself, and an inner portion of the shield 200 extends from the fold 206 to the distal end 204 of the shield, the inner portion being thereby located beneath the outer portion of the shield 200 and the distal end 204 being between the proximal end 202 and the fold 206. This rolling wall configuration enables firm attachment of the shield 200 to the elastic end section of the stretchable segment 16 at both its proximal end 202 and its distal end 204, without inhibiting expansion and contraction of the elastic end section. In embodiments, the shield 200 is made from nylon.

Figure 2B:
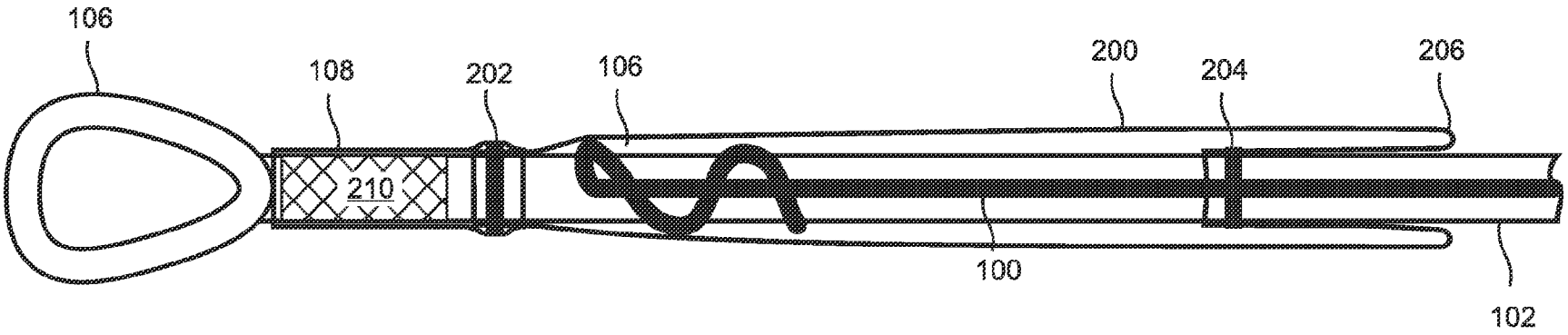
FIG. 2B is a cross-sectional side view of the embodiment of FIG. 2A in a stretched configuration.

As is illustrated in FIG. 2B, when the stretchable segment 16 is stretched in the indicated direction 208, the shield 200 remains attached to the stretchable segment 16 at both ends 202, 204, and adapts to the change in segment length by partially unrolling the rolling wall, so that the outer portion of the shield 200 becomes longer and the inner portion of the shield 200 becomes shorter. The distal end 204 of the shield moves according to the change in length of the stretchable segment 16, while the fold 206 moves only half as far. This unfolding can continue until a maximum shield extension is reached, where the shield's distal end 204 reaches the fold 206, and the fold 206 disappears. Typically, the stretchable segment 16 is configured so that the maximum extension of the braid 102 is reached before the shield 200 reaches its maximum extension.

In the embodiment of FIGS. 2A and 2B, the stretchable segment 16 is terminated by an attachment loop 106, and heat-shrinkable tubing 108 is used to protect the splice 210 that joins the woven braid 102 to the attachment loop 106. This region is not stretchable. The elastomeric core 100 emerges from the woven braid 102 at a location that is not covered by the heat-shrinkable tubing 108. Instead, the attachment of the elastomeric core 100 to the woven braid 102 is protected by the fabric shield 200, so that no part of the elastic core 100 is inhibited from being stretched.

Figure 3:
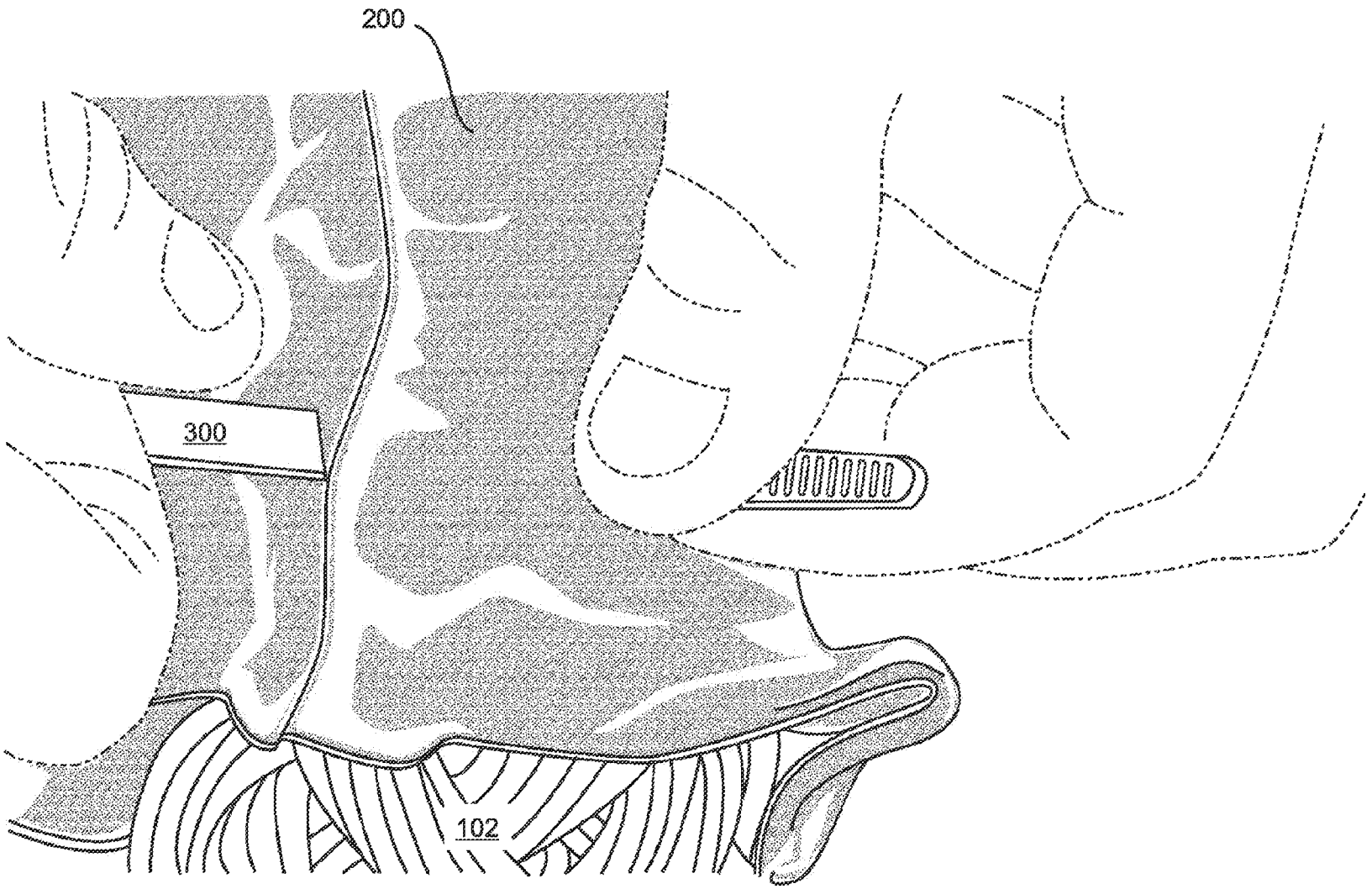
FIG. 3 is a close-up view of a distal end of a shield being attached to a braid by interweaving of a cable tie through the shield and the braid in an embodiment of the invention.

In various embodiments, the shield 200 is attached to the stretchable segment 16 of the rode 10 at the shield's proximal end 202 by any suitable attachment means known the art, such as by sewing or clamping. The shield 200 is attached at its distal end 204 only to the braid 102 by a means that does not inhibit extension of the braid 102 or movement of the elastomeric core 100 within the braid 102. In some of these embodiments, the shield 200 is attached to the braid 102 at its distal end 204 by sewing. In other of these embodiments, the shield 200 is attached to the braid 102 at its distal end 204 by interweaving of a strap, such as a cable tie, through the shield and the braid. An example of a cable tie 300 being interwoven through a shield 200 and through the underlying braid 102 is shown in FIG. 3.

Figure 4:
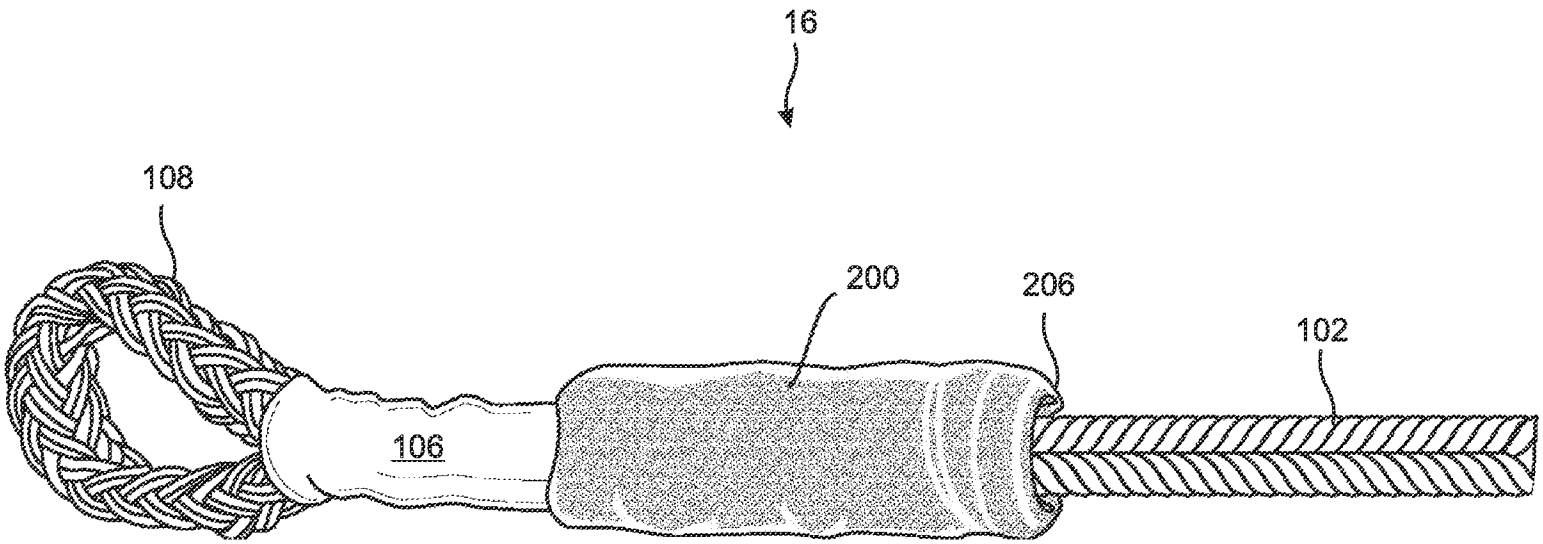
FIG. 4 is a side view of an end of a stretchable rode segment with an embodiment of the invention installed thereupon.

A side view of an embodiment 200 of the present invention installed at one end of a stretchable segment 16 is presented in FIG. 4.

In embodiments, the stretchable segment 16 of the rode 10 can be stretched to a length that is more than 50% longer than its rest length.

The foregoing description of the embodiments of the invention has been presented for the purposes of illustration and description. It is not intended to be exhaustive or to limit the invention to the precise form disclosed. Many modifications and variations are possible in light of this disclosure. It is intended that the scope of the invention be limited not by this detailed description, but rather by the claims appended hereto.

What is claimed is:

1. A stretchable segment of a mooring rode having a shield for protecting a proximal elastic portion of the stretchable segment, comprising:

a stretchable section having an extendable outer braid surrounding an elastomeric inner core, the stretchable section being attached at one end to an inelastic end of the stretchable segment;

a tube of shielding fabric, the tube being folded back onto itself, such that an inner portion of the tube extends from a distal end of the tube to a fold, and an outer portion of the tube extends back from the fold to a proximal end of the tube, the inner portion of the tube being thereby covered by the outer portion of the tube, and the distal end of the tube being thereby located between the proximal end of the tube and the fold;

a first attachment mechanism fixing the proximal end of the tube to the inelastic end of the stretchable segment; and a second attachment mechanism fixing the distal end of the tube to the outer braid at a location distal to a proximal elastic portion of the stretchable section, so that the proximal elastic portion is covered by the tube, said second attachment mechanism being configured to allow substantially unhindered movement of the elastic inner core through the outer braid, so that expansion and contraction of the proximal elastic portion is substantially unhindered by attachment thereto of the tube.

2. The shield of claim 1, wherein the second attachment mechanism includes stitches attaching the distal end of the tube to the outer braid.

3. The shield of claim 1, wherein the second attachment mechanism includes a strap that is interwoven through the shielding fabric of the tube and the outer braid.

4. The shield of claim 3, wherein the strap is a cable tie.

5. The shield of claim 1, wherein the first attachment mechanism includes a clamp that compresses the proximal end of the tube against the inelastic end of the stretchable segment.

6. The shield of claim 1, wherein the stretchable segment is more than 50% longer in a maximally stretched configuration than it is in an unstretched configuration.

7. The shield of claim 1, wherein the shielding fabric includes nylon.

8. The shield of claim 1, wherein the inelastic end of the stretchable segment is covered by tape or by heat-shrinkable tubing.

9. A method for protecting a proximal elastic portion of a stretchable segment of a mooring rode, the stretchable segment including an extendable outer braid surrounding an elastomeric inner core, the proximal elastic portion being an elastic portion of the stretchable segment that is adjacent to an inelastic end of the stretchable segment, the method comprising:

sliding a tube of shielding fabric over the stretchable segment and past the proximal elastic portion, so that a distal end of the tube is closest to the proximal elastic portion, but the tube does not surround any part of the proximal elastic portion;

attaching the distal end of the tube to the outer braid of the stretchable segment using a first attachment mechanism that does not hinder extension of the extendable outer braid or of the elastomeric inner core;

folding a proximal end of the tube back over the distal end, thereby creating a fold in the tube, such that the distal end of the tube is located between the proximal end and the fold; and attaching the proximal end of the tube to the inelastic end of the stretchable segment, so that the proximal elastic portion is fully covered by the tube.

10. The method of claim 9, wherein attaching the distal end of the tube to the outer braid of the stretchable segment includes sewing of the distal end of the tube to the outer braid.

11. The method of claim 9, wherein attaching the distal end of the tube to the outer braid of the stretchable segment includes interweaving of a strap through the shielding material and the outer braid.

12. The method of claim 11, wherein the strap is a cable tie.

13. The method of claim 9, wherein attaching the proximal end of the tube to the inelastic end of the stretchable segment includes using a clamp to compresses the proximal end of the tube against the inelastic end.

14. The method of claim 9, wherein the stretchable segment can be stretched to a length that is more than 50% longer than an unstretched length of the stretchable segment.

15. The method of claim 9, wherein the shielding fabric includes nylon.

16. The method of claim 9, wherein the inelastic end of the stretchable segment is covered by tape or by heat-shrinkable tubing.

* * * * *